US008151937B2

(12) United States Patent
Blemel

(10) Patent No.: US 8,151,937 B2
(45) Date of Patent: Apr. 10, 2012

(54) LEVITATOR—ERGONOMIC WORKER SUPPORT SYSTEM

(76) Inventor: Edward Gerald Blemel, Trijeras, NM (US)

( * ) Notice: Subject to any disclaimer, the term of this patent is extended or adjusted under 35 U.S.C. 154(b) by 1068 days.

(21) Appl. No.: 11/383,142

(22) Filed: May 12, 2006

(65) Prior Publication Data

US 2007/0262619 A1 Nov. 15, 2007

(51) Int. Cl.
*A47D 13/04* (2006.01)

(52) U.S. Cl. ..... 182/115

(58) Field of Classification Search ..... 182/115
See application file for complete search history.

(56) References Cited

U.S. PATENT DOCUMENTS

| | | | | | |
|---|---|---|---|---|---|
| 16,329 | A | * | 1/1857 | Ernst | 182/16 |
| 38,586 | A | * | 5/1863 | Knowlton | 182/23 |
| 124,940 | A | * | 3/1872 | Edmunds | 182/206 |
| 448,082 | A | * | 3/1891 | Salisbury | 403/389 |
| 799,360 | A | * | 9/1905 | Smith | 182/189 |
| 2,415,327 | A | * | 2/1947 | Yothers | 182/120 |
| 2,701,168 | A | | 2/1955 | Schemers | |
| 2,969,123 | A | | 1/1961 | Jamerson et al. | |
| 2,970,668 | A | | 2/1961 | Snyder | |
| 4,044,979 | A | * | 8/1977 | Lemmo | 248/647 |
| 4,072,209 | A | | 2/1978 | Bolis | |
| 4,354,725 | A | * | 10/1982 | Herbaugh et al. | 439/736 |
| 4,397,374 | A | | 8/1983 | Rumage et al. | |
| 4,530,419 | A | * | 7/1985 | Rumage et al. | 182/106 |
| 4,542,806 | A | | 9/1985 | Olson | |
| 4,618,209 | A | | 10/1986 | Sonobe | |
| 4,727,958 | A | * | 3/1988 | Botello | 182/15 |
| 4,863,178 | A | | 9/1989 | Friesen | |
| 4,867,273 | A | * | 9/1989 | Schaevitz | 182/116 |
| 4,922,836 | A | * | 5/1990 | Damico | 108/146 |
| 4,942,649 | A | * | 7/1990 | Anthony et al. | 24/637 |
| 4,964,487 | A | | 10/1990 | Webb et al. | |
| 5,080,381 | A | * | 1/1992 | Perez | 280/35 |
| 5,126,928 | A | * | 6/1992 | Hughes | 362/287 |
| 5,295,728 | A | * | 3/1994 | Schaevitz | 297/195.1 |
| 5,460,392 | A | * | 10/1995 | Hansen | 280/32.6 |
| 6,102,156 | A | * | 8/2000 | Lipniarski | 182/118 |
| 6,105,719 | A | * | 8/2000 | Lensing | 182/116 |
| 6,106,490 | A | * | 8/2000 | Shaw | 601/49 |
| 6,540,301 | B1 | * | 4/2003 | Bottoms | 297/423.11 |
| 6,595,590 | B2 | * | 7/2003 | Bottoms | 297/423.11 |

(Continued)

OTHER PUBLICATIONS

Etoolcart.com; "Overhead Creeper—TL72300," 1-page advertisement, for product by "Techlift," from website www.etoolcart.com, downloaded Apr. 7, 2005.

(Continued)

*Primary Examiner* — Alvin Chin Shue
(74) *Attorney, Agent, or Firm* — Rod D. Baker

(57) ABSTRACT

An ergonomic worker support stand with convenience features for reducing stress and supporting either the upper or lower portion of a person's body is disclosed. The stand is designed for safety, convenience and comfort in performing worker tasks. My patent includes features that reduce stress, conserve energy, and facilitate increased work productivity are important to physically challenged persons as well an able bodied worker. The stand is separable, adjustable and foldable to make it compact for storage purposes. The ergonomic stand, in the operational position, provides a sturdy, balanced, adjustable, and ergonomic platform for the support of the worker, appliances and tools. The stand has features for lighting of the workspace, holding work related accessories, powering electrically, hydraulically or pneumatically operated tools. The stand has ports for connecting personal data assistants, wireless communications, and computers used in accessing worker instructions and information.

13 Claims, 10 Drawing Sheets

Preferred Embodiment of the Worker Support Stand

U.S. PATENT DOCUMENTS

| | | | | |
|---|---|---|---|---|
| 6,641,146 | B2 * | 11/2003 | Reese | 280/32.6 |
| 6,729,438 | B1 * | 5/2004 | Perrett | 182/129 |
| 6,824,149 | B1 * | 11/2004 | Whitlock et al. | 280/32.6 |
| 6,957,718 | B1 * | 10/2005 | Whiteside et al. | 182/115 |
| 2003/0107195 | A1 * | 6/2003 | Zambanini et al. | 280/47.34 |
| 2006/0180054 | A1 * | 8/2006 | George et al. | 108/50.11 |
| 2007/0241523 | A1 * | 10/2007 | Lewman | 280/32.5 |
| 2008/0150246 | A1 * | 6/2008 | Lox et al. | 280/47.34 |

OTHER PUBLICATIONS

Etoolcart.com; "Overhead Creeper—ATD8116," 1-page advertisement for product by ATD Tools, from website www.etoolcart.com, downloaded Apr. 7, 2005.

* cited by examiner

Preferred Embodiment of the Worker Support Stand

Top view of Ergonomic Upper Torso Support

Bottom View of Ergonomic Upper Torso Support

Front View Ergonomic Worker Support with Adjustable Seat

Base of Ergonomic Worker Support

Ergonomic Worker Support with Extender Piece

Wroker Support Stand with Upper Torso Support Articulated at High Elevation

Collapsed View of Ergonomic Worker Support Stand

LEVITATOR—ERGONOMIC WORKER SUPPORT SYSTEM

FIELD OF THE INVENTION

My invention is directed, in general, to a worker support platform with ergonomic features for reducing stress and strain on the worker and for worker comfort, safety and convenience when servicing vehicles and other objects.

BACKGROUND OF THE INVENTION

In industry and business today, there are many jobs, such as working over blueprints or sections of materials, or underneath an airplane or automobile, on a building, a machine, or other object that requires the worker to articulate and contort to accomplish the task at hand. For example, from time to time, the worker may need to adjust their upper body position and perhaps bend at the waist forward or backward for a period of time for work convenience, or to reduce strain of muscles or for other ergonomic reasons, perhaps caused by a congenital defect, previous injury, weakness or physical handicap. Otherwise the worker's position can put severe strain on joints and press into muscles and there is usually fatigue and sometimes possibility of a very costly accident or muscle strain. In some cases, it is possible to put some temporary support, such as a cushion, under part of the body, but this then causes a delay in job performance when the support must be taken up and repositioned, and the cushion might fall and scratch or otherwise damage the surface or components of the object being worked on. In many jobs, varying the height or extending out over the work area is required and temporary cushions cannot be used at all. Further, in the current worker environment it is more and more necessary to access electronic devices and digitized images of technical manuals and part specification data sheets from remote computers. In addition, it is now commonplace to communicate electronically with distanced specialists familiar with the tasks at hand. Otherwise the worker must leave the support stand and access these remote sources via telephone or a local computer at another worksite. Lighting of the work area and the equipment being worked on is also important, because poor lighting causes eye strain and potentially injury to the worker if the worker and work stand are not easily recognized in darkness. Since worker fatigue is cumulative during the work interval the addition of ergonomic features lessens the overall effect on the worker. Further, some strain, such as on the elbow in lifting, has an injurious cumulative effect on the skeleton and musculature that can be alleviated by ergonomic support. Some work positions are more comfortable when sitting and moving heavy tools and awkward to carry items up or down the worker stand can be very stressful so a levitation means is needed to conveniently and safely adjust the configuration of the worker's support stand, change the worker support to a more ergonomic configuration, and move work items up and down or sideways reducing worker stress. There is also a need, often required by law, to provide safety from sunlight, rain and sharp edges as well as warnings of unstable or unsafe conditions such as electrical shock or tipping over due to imbalance when working on unlevel surfaces. There is a need to provide ways for enhancing safety such as leveling the worker stand when working on uneven surfaces as well as extending appendages or adding ballast to the structure to prevent tip-over of the workstand. To protect the worker's safety a place to secure a safety belt is needed. To prepare for the event of an injury, places are needed to conveniently attach immediate first aid items, such as first aid kit with sterilizers, tourniquets, bandages and a pressurized eyewash that can be activated, perhaps with a hand operated plunger or button.

DESCRIPTION OF PRIOR ART

Prior art shows several forms of moveable or stationary worker support stands. There are utilitarian structures with fixed height constructed with sharp angles, sharp edges and hard surfaces that can be injurious to the worker or others in the workplace, or to the equipment being serviced by the worker. In general these units are produced with little regard to creature comfort, well-being.

There are known devices to assist a mechanic when working on an automobile or the like. U.S. Pat. Nos. 4,867,273 4,618,209, 4,542,806, 4,530,419, 4,397,374, 4,072,209 and 2,969,123 all disclose forms of mechanic's support. These devices have frame members held together by struts or scaffolding and provide a resting platform for a worker's upper body. Some of these inventions have a plurality of wheels fixed at the corners of a basically rectangular-shaped undersurface and others include a ladder extending upwards from the base. Most of these patents address jobs where the worker's body position is leaning forward at the waist. U.S. Pat. No. 4,867,273 provides a means for leaning backward while working.

These teachings, being utilitarian, do little to be ergonomically adjustable or to have ergonomic shapes or to have conforming ergonomic surfaces that would tend to reduce the stress and strain on the worker's skeleton or muscles. Similarly these teachings are not intended to assist physically challenged persons in setup or use. Of particular note is a lack of features to accommodate appliances, affix tools, provide support structures, or automated features that would make the work easier and safer to accomplish.

Further, all of these patents are technologically challenged, designed for use in prior generation tasks. For example, none of these devices provide means for wireless communication to shop or internet computers. None of the prior art discloses a means to extend or retract the position of the chest support means to facilitate accomplishing the work. All these devices are grossly utilitarian with no mention of ergonomic design such as means for adjusting the forward/backward leaning angle of the main stem. All these devices are grossly utilitarian without mention of user-adjustable ergonomic design to eliminate or reduce strain and pressure on reduce stress on worker body parts.

There is an obvious need for a worker's support stand that provides features for enhanced worker safety; ergonomic support for body parts; ergonomic adjustable work area illumination devices; points to supply power for devices and tools used by the worker; an adaptive structure for ergonomically support workers of various shapes and sizes; internet or local area network for digital communications, safety alarms; and other ergonomic features that lessen the stress of work while the worker is performing work duties when mounted on the worker's support stand. The need extends to having coatings that reflect light from the worker support stand surfaces in case of use along a highway or other hazardous place where worker safety is a risk due to circumstances. In certain cases the need exists for worker support stand assistive devices that help tired or physically challenged persons perform the work tasks.

SUMMARY OF THE INVENTION

My invention relates to a stationary or movable structure that provides an ergonomic worker support; one that can adapt and adjust to support the worker's body parts while the worker is performing tasks, has illumination features; safety features; convenience features for holding tools; powering electronic appliances; and connections to access data networks including those connected to the Internet. In a preferred configuration my invention has adjustable levitation and or support means to support various body parts and protrusions from the stem of varying length on the upright stem, arranged so as to not touch or interfere with the worker's body parts. The height of the support means can be extended by inserting addition sections and the angle varied by changing the location with the bracket; and the angle of the position of the surface that ergonomically supports the worker's upper torso. Convenience features include reflective labels (or surface); work area illumination; first aid devices such as salves, bandages, tourniquets and an eyewash; data and computerized device ports; an audible alarm; protection from electrical shocks and reconfigurability to meet individual comfort requirements. My invention has convenient handles for moving the support stand. My invention has interfaces to facilitate connection of power to tools. My invention includes features that aid or assist the physically challenged worker. Once set up, my invention provides features that enable the worker to safely change the position of the worker workstand components to sustain the benefits of the stress reduction, comfort, and ergonomic features.

OBJECTS AND ADVANTAGES

The object of my invention is to provide a worker with a convenient support stand with ergonomic features that, through use, serves to reduce stress and strain from worker tasks which can result in pain from medical problems such as bursitis, sciatica or injury to bones, muscles, ligaments and tendons.

A further object is to provide a collapsible means to reduce size thereof when not in use.

A further object is to provide proper illumination means for lighting said worker support stand and its vicinity reducing eye strain.

A further object is to provide work item holding means to hold tools and accessories temporarily.

A further object is a stem means whereby the worker can adjust the position of the torso support for personalized comfort.

A further object is to provide the worker support stand with power provisioning means for supplying power to tools and devices used in performing work.

A further object is to provide the worker with safety device attachment means as a place to attach appliances that protect the worker from hazards.

A further object is that the worker support stand work indoors and outdoors on flat or uneven surfaces relieving the worry and strain of working on a tilted work stand.

A further object is that it provide improved visibility when struck by an external source of light so as to relieve the worker's concern of being difficult to see in poor light, especially in side of highway locations.

The advantages of my ergonomic worker's support stand are many, to with:

{1} My invention provides ergonomic comfort and safe support to workers who must use their body parts to perform tasks while they are in an unbalanced or awkward position, such as working on the windshield or engine of an automobile.

{2} The apparatus of my invention can be configured to ergonomically articulate to accommodate a worker or user of diverse size, shape, sex or weight who might be performing tasks that call for, for instance, leaning backward and working overhead, or while sitting or standing, or leaning forward on their knees or chest; or leaning forward from the heels or from the waist over an engine compartment.

{3} The apparatus of my invention provides power for means that reduce stress and strain in performing tasks, or that aid or assist a physically challenged worker or user such as a person with a sprained muscle or perhaps a partial or full paralysis in an arm or leg, who needs additional strength or lifting support that make the job at hand safer and indeed even possible for a physically challenged person.

{4} My invention provides the worker with a sturdy, comfortable and reliable, but yet efficiently usable, support that is convenient and safe to articulate, position, adjust, and utilize during work.

{5} My invention is adjustable in vertical, breadth, and width dimensions to move and fit into difficult to address places.

{6} My invention has ergonomic features with individually customizable adjustable contours that better provide body comfort.

{7} My invention has an extensible stem with a variable slope that provides ergonomic body-position and contour support with range of comfortable slopes and shapes.

{8} My invention has ergonomic foot rests that can rotate to angle that provides best foot comfort that does not press or stress against shin and thigh bones and comfortably support the hips and spine.

{9} My invention has an adjustable extendible chest support with optional customized padded contour with latching rotation to ergonomically accommodate a man or a woman.

{10} My invention accommodates replaceable or rechargeable power sources such as a fuel cell, pressurized tank or battery. The power can be used for comfort heating and to operate a plethora of electronic devices including lights, microphone headsets, computers, personal digital assistants, and electrical tools used in performing the task.

{11} My invention is equipped with multiple interfaces to connect to external power sources for ergonomic adjustment and for tools.

{12} My invention is equipped with multiple power outlets including electrical sockets for lighting the focused workplace, and electrical, hydraulic and pneumatic outlets for powering diverse user electronic aids and tools.

{13} My invention is equipped with multiple places for attaching or holding diverse, parts, aids and tools.

{14} My invention has smooth contoured handles with curved edges for safety to the passerby.

{15} My invention has a mobility means.

{16} My invention has ergonomically support places which are arm/elbow rests that tend to reduce strain and when changing body position and holding aloft tools and other items.

{17} My invention can be easily adjusted to fit and ergonomically support the skeletal part and muscular shape of the user.

{18} My invention is itself contoured to least interfere with movements of arms and legs.

{19} My invention provides a combination seat for sitting that doubles as a knee rest for work in a kneeling position.

{20} The contours of my invention are of curved construction that acts to prevent damage to the worker or to those who accidentally come into contact with the framework.

{21} My invention has protruding contours that are curved, made or coated with a soft cushioning material to lessen the chance of causing scratches or other damage during positioning.

{22} My invention can be set up to ergonomically accommodate the size, weight, and, form of an individual worker.

{23} My invention can be tilted to ergonomically accommodate the worker at any of multiple angles to reduce strain on the skeleton and muscles in hard to reach places.

{24} My invention has extendable's for items such as lights and lighted mirrors to provide illumination or comfortable view into dark areas where manual or visual tasks are performed.

{25} The contoured lines of my invention acts to prevent damage to the worker or to those who accidentally come into contact with the framework.

{26} My invention is quickly reconfigured, reassembled for personal ergonomic comfort.

{27} My invention is easily collapsed and folded, when the task is completed, to be stored out of the way.

{28} My invention accommodates electronic devices used in performance of work or that provide comfort to the worker.

{29}The base of my invention can be filled with, or overlaid with, ballast to provide stability.

{30} My invention allows adding leveling devices and horizontally disposed appendages to provide safety and stability.

{31} My invention provides power for environmental conditioning means such as a fine water spray that is released in very hot weather or a heater pad that provides warmth during very cold weather.

{32}Throughout this application the term ergonomic means comfortable support while reducing stress and strain on skeletal joints, tendons, ligaments, eyes and muscles. The American Heritage Dictionary of The English Language defines ergonomics as "Design factors, as for the workplace, intended to maximize productivity by minimizing operator fatigue and discomfort".

LIST OF REFERENCE NUMERALS

101 mobility means
102 base
103 adjustable stem bracket
104 adjustable ergonomic seating
105 upright stem
106 lower extremity support
107 upper torso support
108 base-to-stem joining
109 dielectric insulation
110 dielectric coupling
111 dielectric materials
112 electrostatic discharger
113 leveling means
114 storage compartment
115 work item attaching means
116 ergonomically adjustable foot-knee support
117 multi-directional positioner
118 upper torso appendage support
119 power source
120 light reflector
121 work-device attachment means
122 extender
123 mobility device attachment means
124 refillable ballast
125 filler aperture
126 stabilizing appendage
127 extension-of-stems fitting
128 upper torso support assembly latch
129 communicator device connector
130 upper torso support extender
131 upper torso support assist means
132 upper torso support item holder
133 ergonomic material
134 upper torso support reverser
135 upper torso support opposing side
136 inclination indicator
137 energy attachment means
138 handle
139 protective substance
140 tray attachment means
141 stem assembly latch
142 means for attaching protective shield
143 safety belt attachment point
144 work item support
145 levitator
146 stem extender piece
147 tray-compartments
148 illumination devices
149 adjustable seat mount
150 control panel
151 work item transporter
152 first aid kit
153 computer holder
154 upper torso support frame
155 refreshment holder
156 stowage latch
157 tray
158 stem levitator
159 environment conditioner

BRIEF DESCRIPTION OF DRAWINGS

The novel aspects of this invention are set forth with particularity in the appended claims. The invention itself, together with further objects and advantages thereof may be more readily comprehended by reference to the following detailed description of presently preferred embodiments of the invention, taken in conjunction with the accompanying drawings. The drawing elements used throughout each drawing are for example only.

The utility of the apparatus can be extended by adding accessories and other items from the list of reference numerals. The drawing elements used throughout the figures are for example only.

DESCRIPTION OF THE INVENTION

Figure 1:
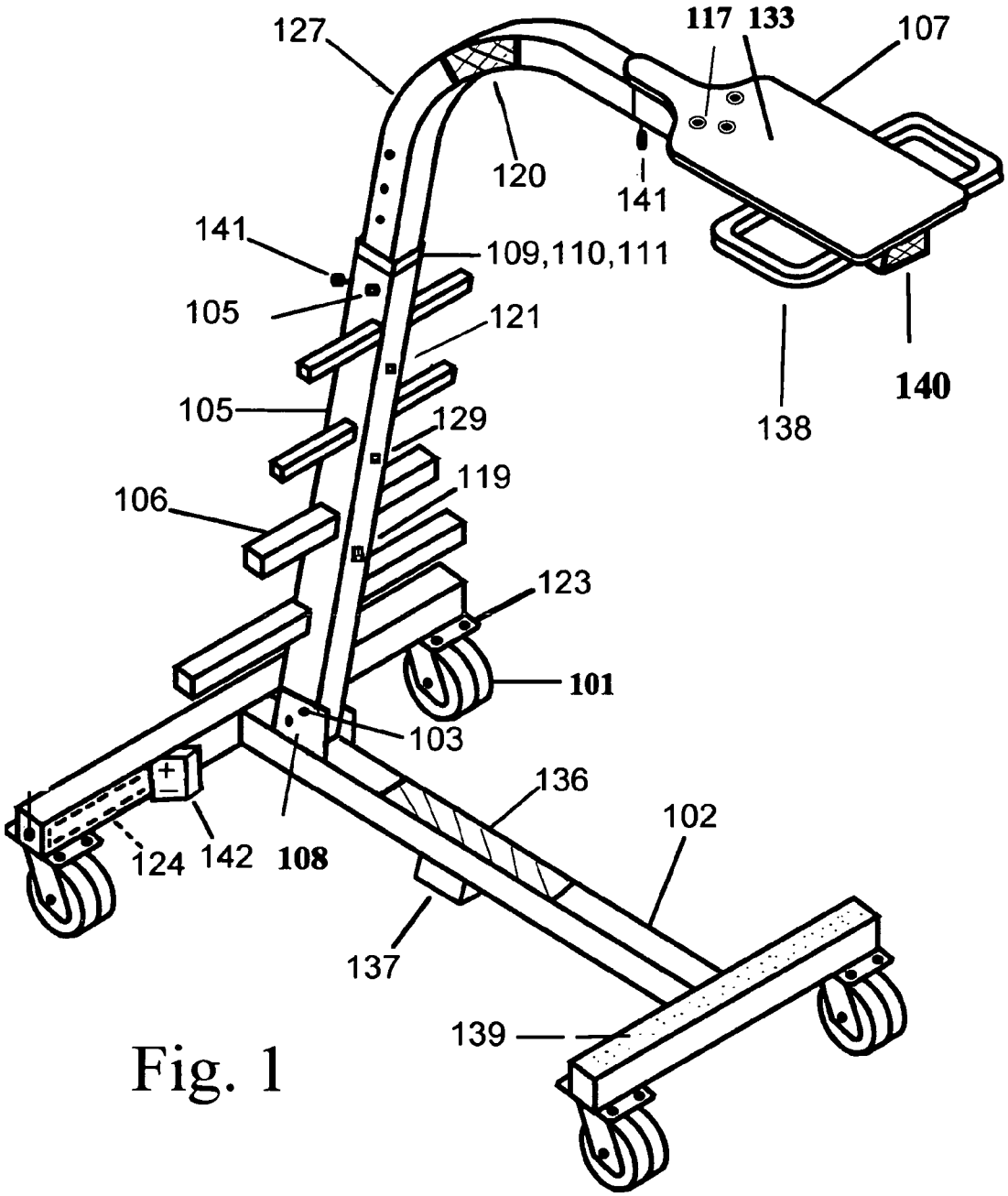

According to one embodiment of my invention, a mobile ergonomic worker support stand is built with a sturdy frame that assembles in a manner that is ergonomically configured for an individual worker, but readily adjusts to ergonomically meet another worker's needs. In a preferred embodiment the ergonomic worker support stand has means for assisted erection to allow ergonomic telescopic movement such as square, round or "u" shaped parts with predetermined inner dimensions of height and width that slide or fit over and into support couplings. The mounting brackets are constructed with adjustable limits so that the ultimate shape of the structure is ergonomically adjusted to the shape of the worker in a manner that minimizes strain on muscles, ligaments and tendons. Further, the structure can be articulated left, right, up and down, and in a preferred embodiment can be so manipulated when occupied by the worker to move into a more convenient or comfortable position such as when lifting a part, or reaching to perform a task.

In a preferred embodiment of the apparatus, worker safety is foremost. The apparatus includes features for safely positioning, leveling, and securing it in a level configuration at its selected location. The apparatus is articulated to provide user selected optimum comfort and safety. In addition in the preferred embodiment the worker is protected from hazards, whether electrical, thermal, or chemical or in the event of falling debris. For example the mobility means can be locked so as not to move. The worker can be protected from electrical shock by using dielectric materials such as rubber or non-conducting plastics that interface to metal parts, and a ground wire may be provided that dissipates static buildup to prevent electrostatic discharge. A protecting cage structure can be accommodated that forms a surrounding protective shield to protect the worker from splattering chemicals, steam, falling objects, flames, and other external hazards.

In a preferred embodiment the surface of the worker stand is built with a soft, non-scratching protective substance [139] to protect against damage to things that could be scratched or dented or otherwise damaged by the support stand.

In a preferred embodiment, the worker is protected from hazards of electrical hazards by dielectric materials [109] that act to prevent electrocution.

In a preferred embodiment the dielectric coupling of the shaft could be plastic or ceramic or other dielectric material [110].

In a preferred embodiment the multi-directional positioner [117] enables adjusting the articulated rotation and azimuth angle the upper torso support [107].

In a preferred embodiment of the apparatus the foot-knee support [116] has opposing wing-shapes, and is motile in a plurality of positions for ergonomic comfort or bracing.

In a preferred embodiment indicators of the amount of inclination from perpendicular and horizontal [136] provide a measure of peace of mind when setting up the worker support stand.

LIST OF FIGURES

FIG. 1 illustrates a perspective view of a basic instance of the worker support stand.

Figure 2:
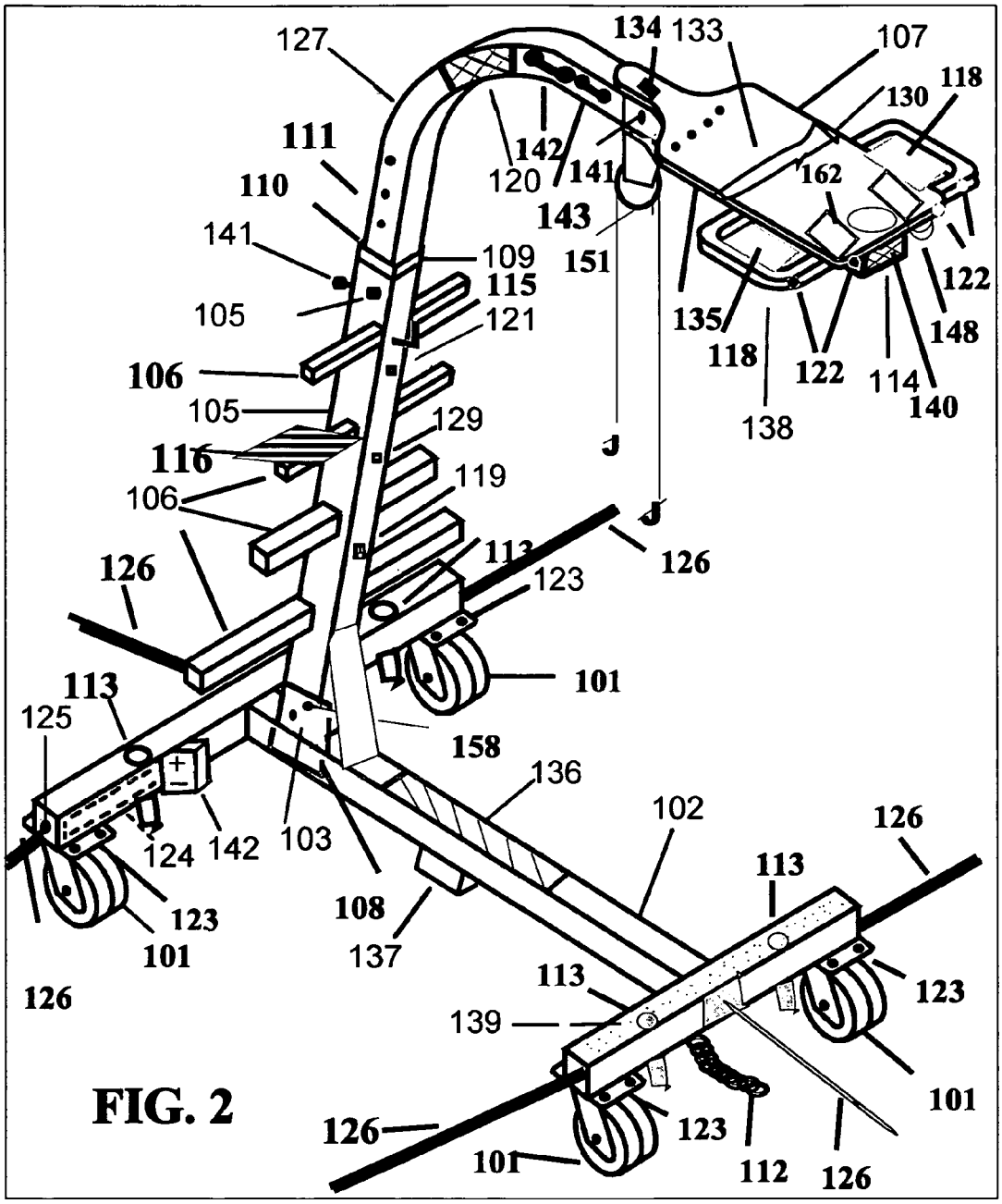

FIG. 2 illustrates a perspective view of a preferred embodiment of the worker support stand.

Figure 3:
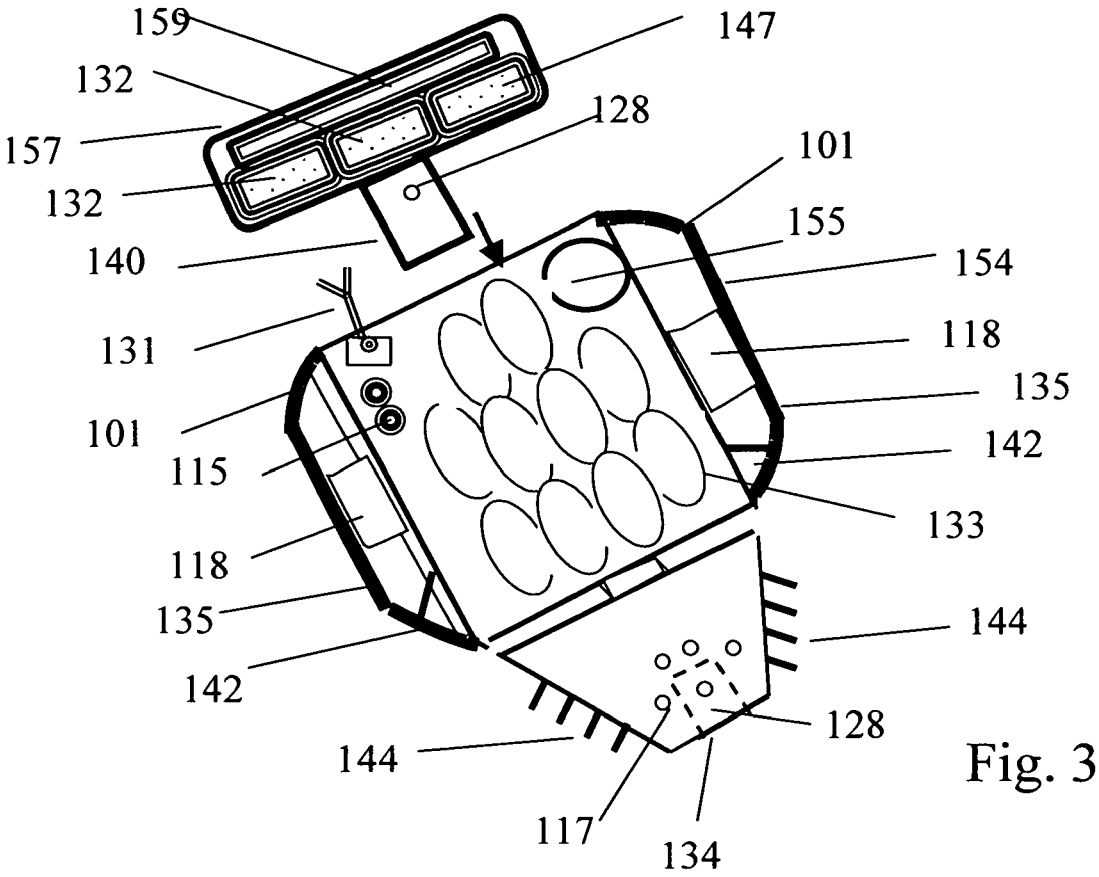

FIG. 3 illustrates a from-above view of the ergonomic upper torso support.

Figure 4:
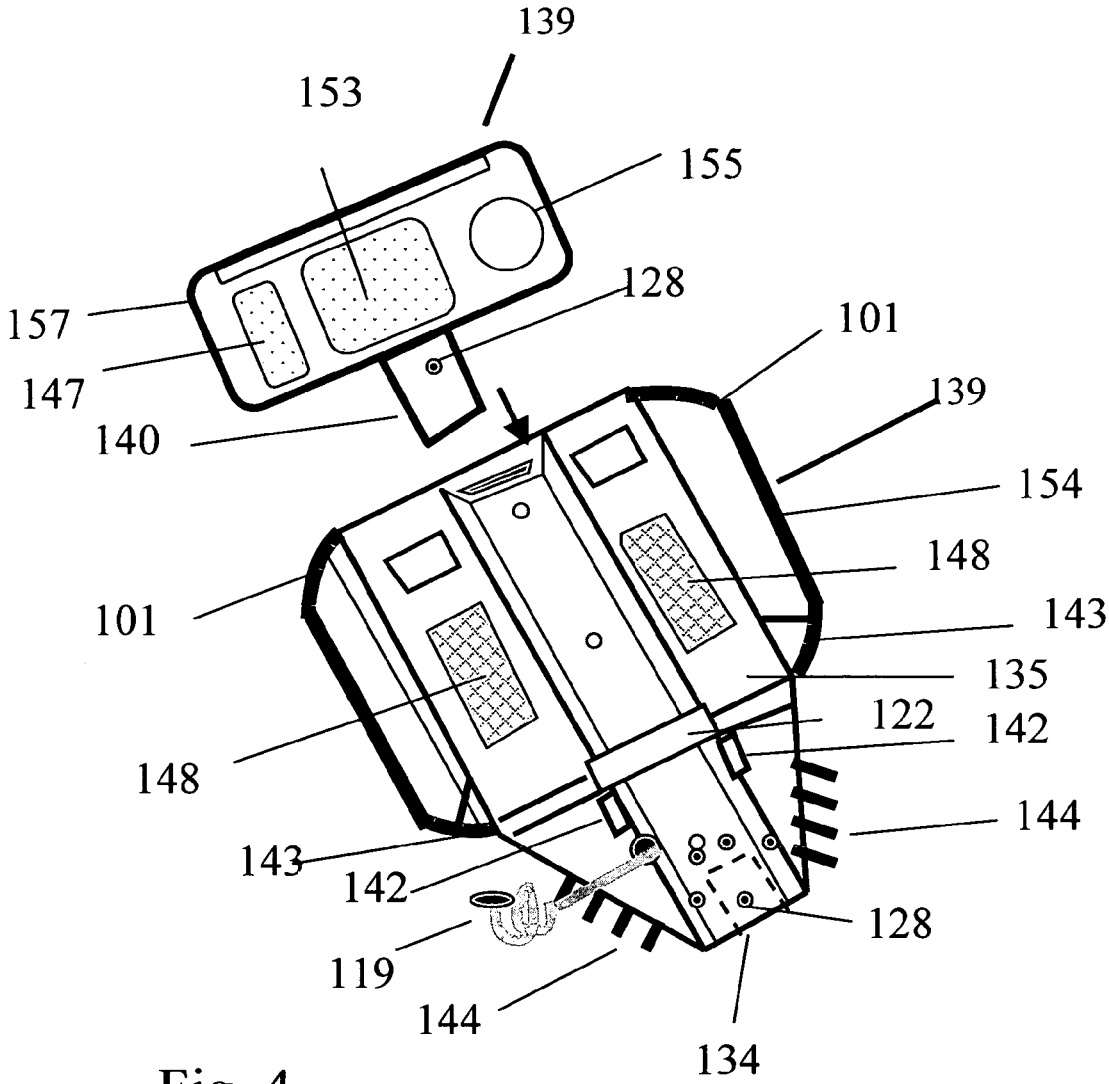

FIG. 4 illustrates a from-below view of the ergonomic upper torso support.

Figure 5:
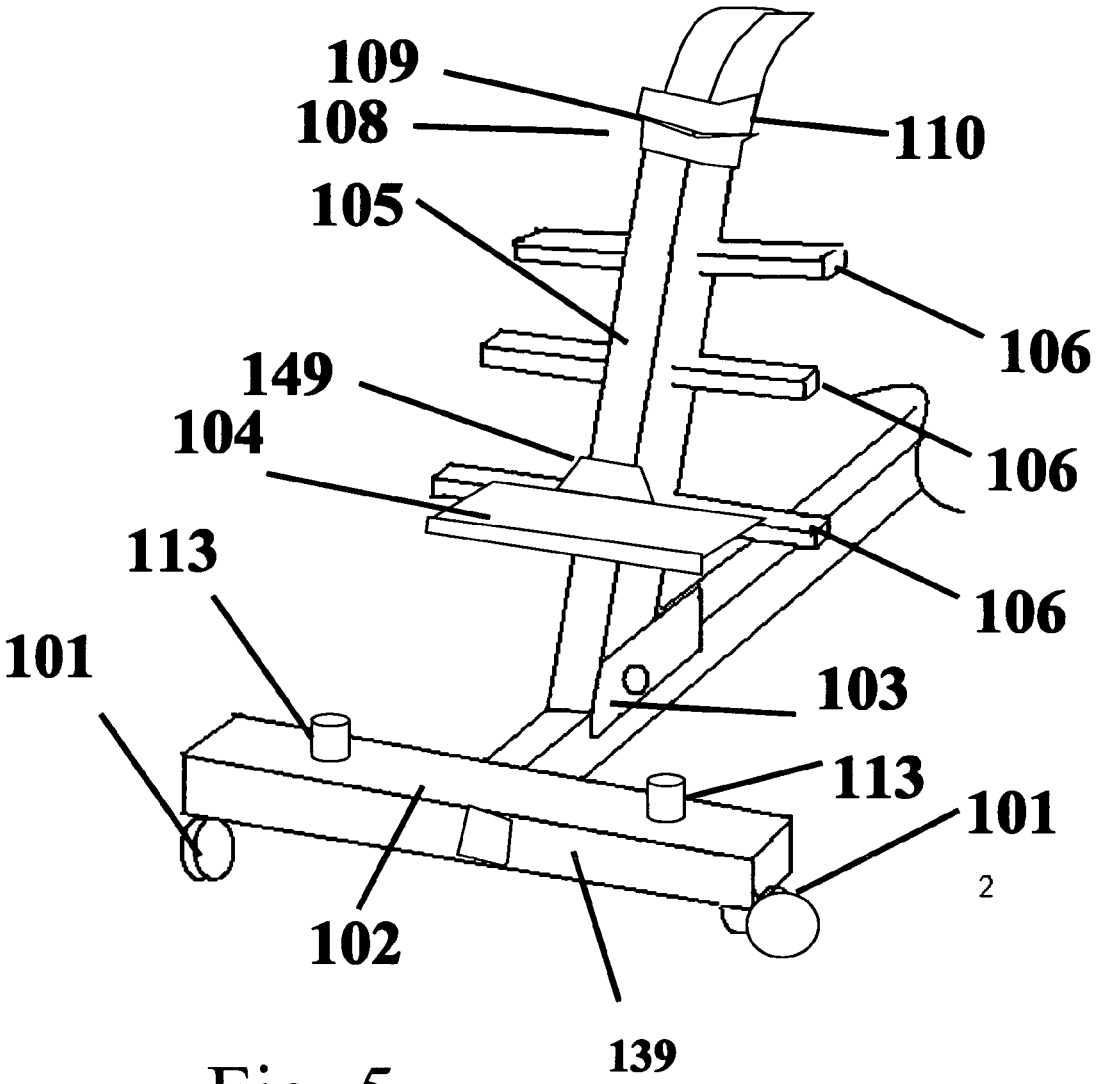

FIG. 5 illustrates a frontal view of the worker's support with adjustable seat means.

Figure 6:
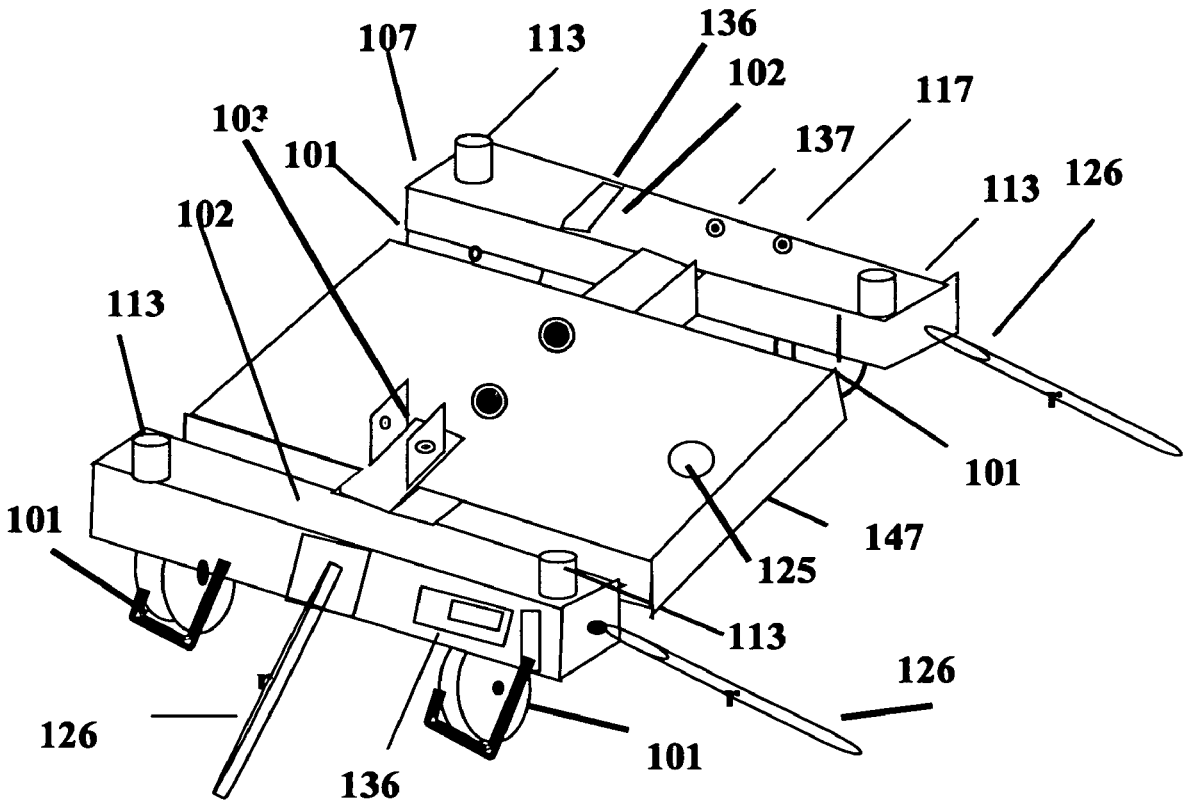

FIG. 6 illustrates a view of the base means of the worker's support stand.

Figure 7:
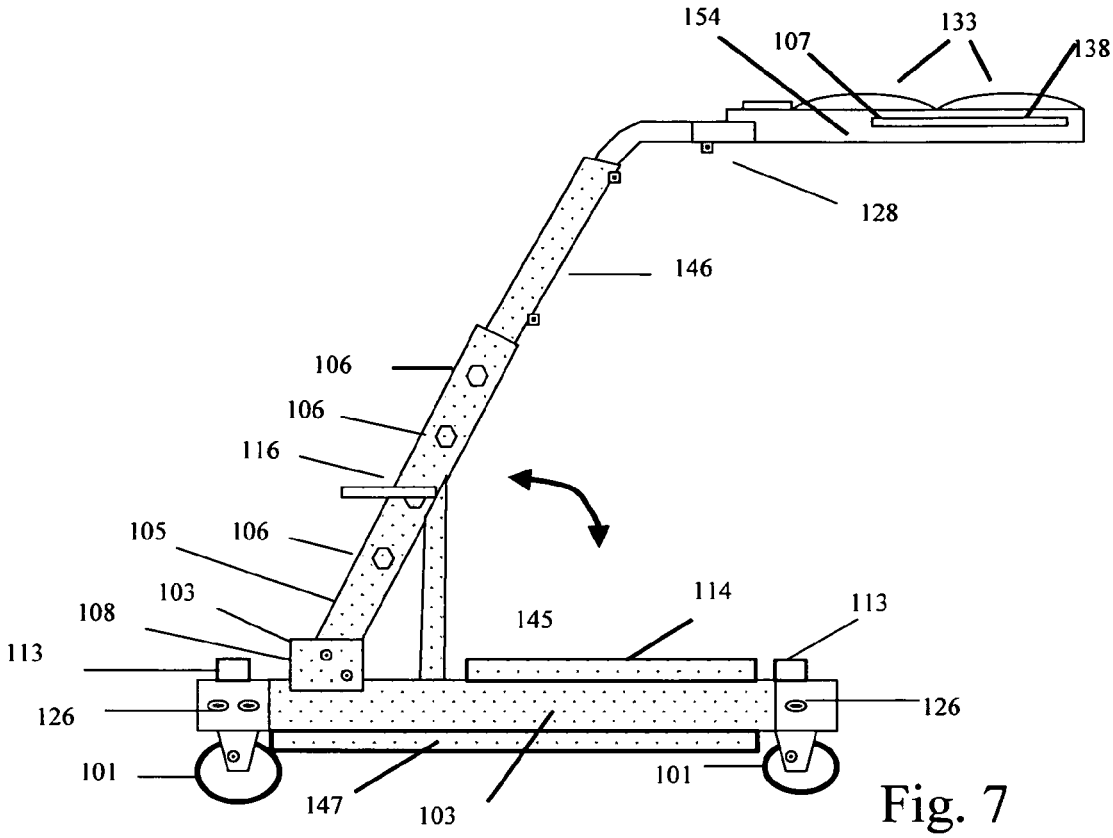

FIG. 7 illustrates a right side view of the worker's support stand with an extender piece.

Figure 8:
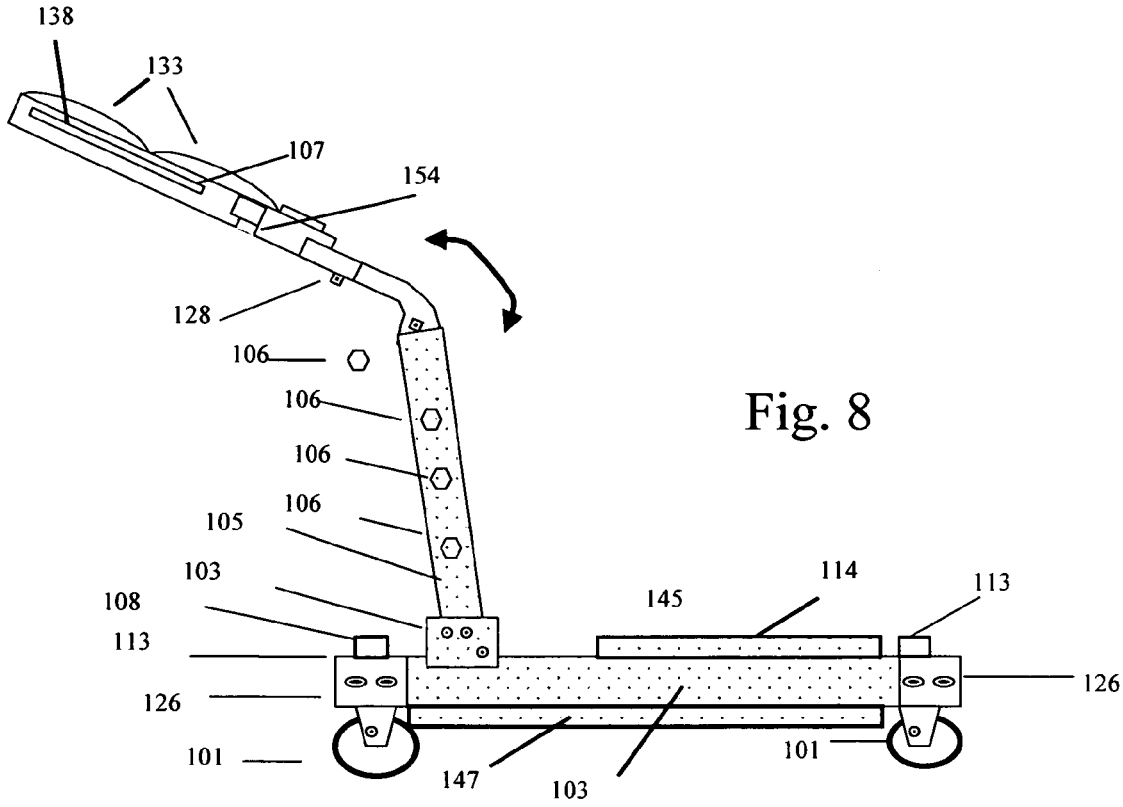

FIG. 8 illustrates a right side view of the worker's support stand with the upper torso support articulated at a high elevation.

Figure 9:
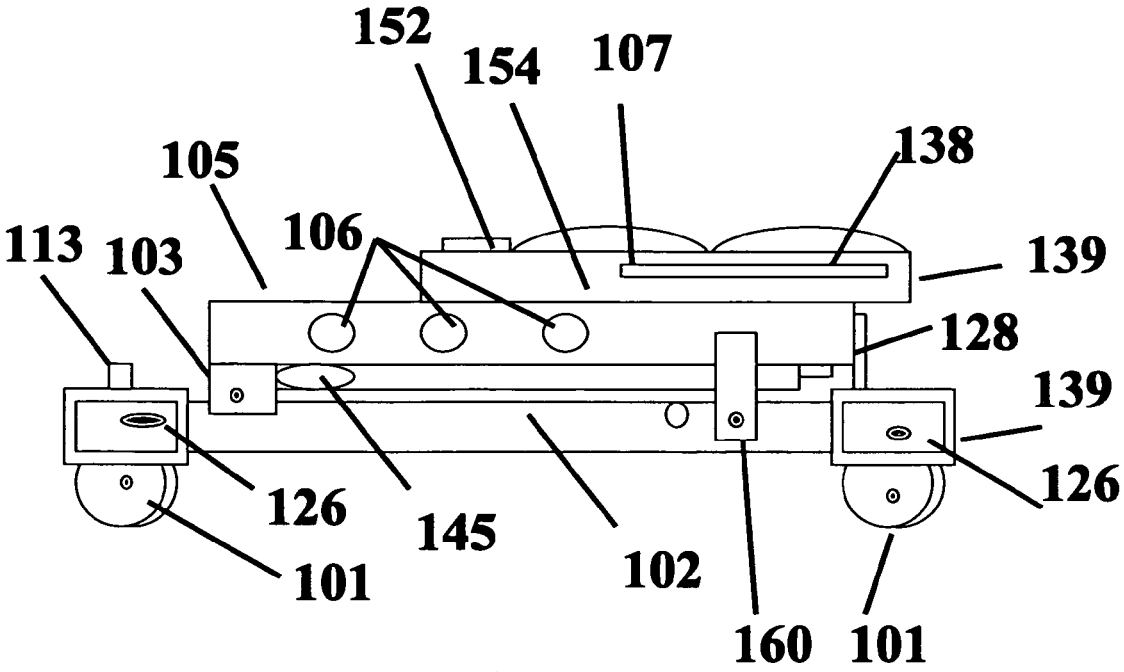

FIG. 9 illustrates a side view of the worker's support stand in a collapsed position.

Figure 10:
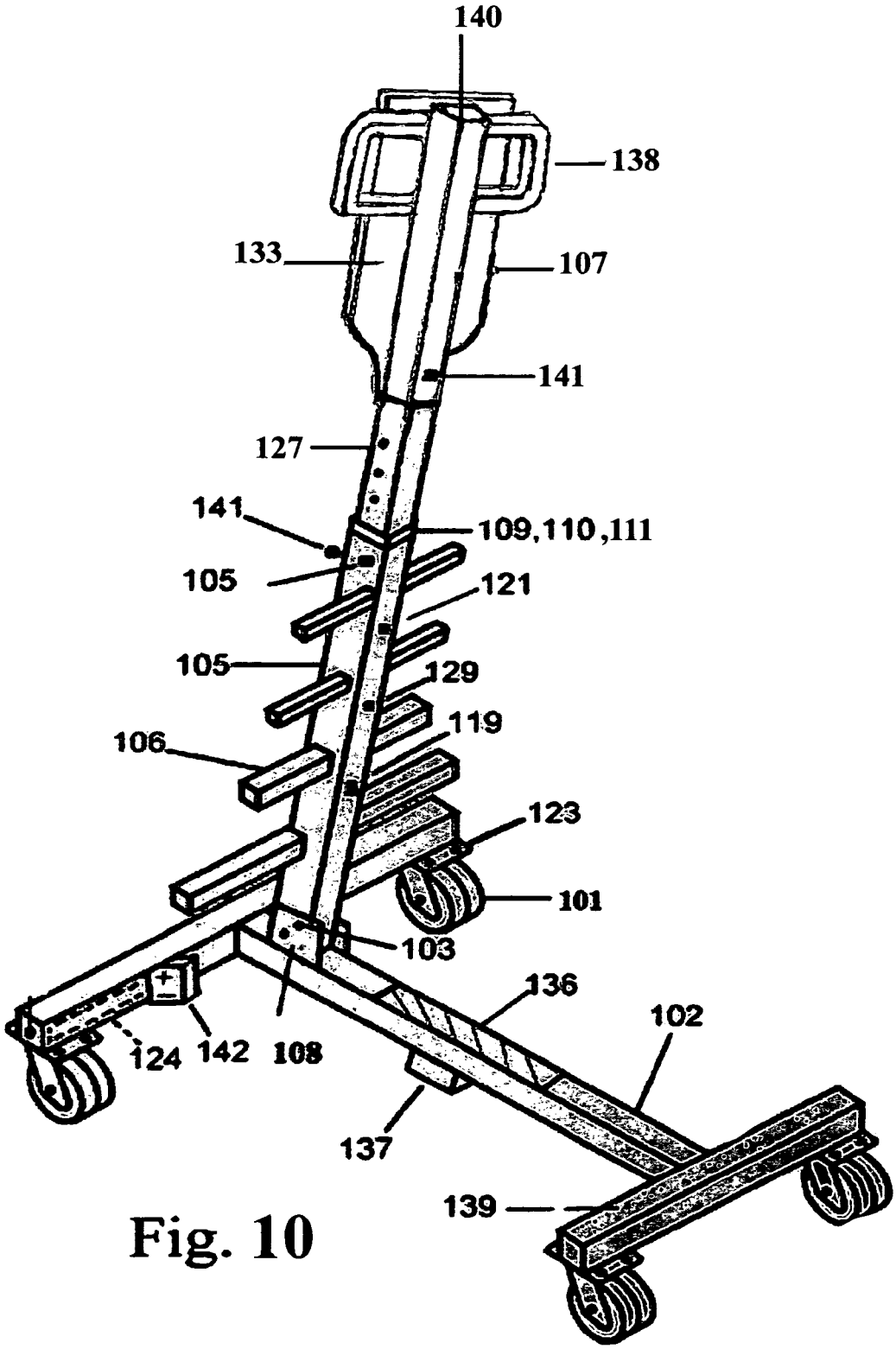

FIG. 10 is a perspective view of a basic embodiment of a worker support stand according to the present disclosure, showing an upright extension of stem fitting.

REFERRING TO THE NUMERALS AND DRAWINGS

The previously described drawings are provided to show a preferred embodiment of the worker's support stand. The elements in the drawings show diagrammatically the features identified in the list of drawing elements. The representations of the drawing elements are only representative and can be implemented in various ways in practice.

Reference now is made to FIG. 1, which diagrams a perspective view of the worker's support stand. FIG. 1 shows the worker support stand set up in a minimalist configuration without ergonomic, safety and work saving features illustrated in other figures. FIGS. 1 and 2 show how an upper torso support [107] is provided with rounded handles [138] which provide means for moving the apparatus, and with an upper torso appendage support [118]. The upper torso support [107] is fitted to the topmost upright stem [105]. A stem joining means [108] at the lowest end of the upright stem [105] is shown mated to an adjustable stem bracket [103] that is affixed to the base [102]. The base [102] is fitted with mobility means [101], such as wheels as shown for example in FIG. 2.

As seen in FIGS. 1 and 2, the upright stem [105] has thereon a plurality of oppositely protruding lower extremity supports [106] that additionally serve as means to ascend the worker stand; each lower extremity support provides a firm footing. Further, as one ascends the upright stem [105], the lower extremity supports [106] are progressively foreshortened, each extremity support being shorter than the support below it. This shortening of the higher extremity supports avoids user discomfort caused by lower extremity supports touching the user's lower extremities, or strain from restraint of extremity movement caused by the support steps [106]. The lowest of the several extremity supports [106] are shown in FIG. 2 fitted with a ergonomically adjustable foot-knee support [116] that flexes during use for reducing foot muscle strain. FIG. 5 shows an adjustable ergonomic seating [104] that can be positioned on a lower extremity support [106] to a worker's preferred position when the worker needs to use perform tasks in a sitting or squatting position.

FIG. 1 shows diagrammatically dielectric insulation [109]; dielectric coupling [110]; multi-directional positioner [117] useable to pivot the upper torso support to a more efficient worker position; auxiliary power source [119] such as a pneumatic, hydraulic, or electrical power source; light reflector [120]; work-device attachment means [121]; mobility device attachment means [123] (for example wheel brackets as shown) to enable convenient movement of the worker support stand from place to place; energy attachment means [137]; handles [138] for positioning the ergonomic worker stand; protective substance [139] coating the surfaces; tray attachment means [140]; stem assembly latch [141]; means [142] for attaching a protective shield (not shown) to the ergonomic worker stand; safety belt attachment point [143] (FIG. 2); and work item support means [144] (FIG. 3).

FIG. 2 illustrates a preferred embodiment of the ergonomic worker support stand enhanced for safety, reduced bodily strain and improved comfort. The embodiment diagrammed in FIG. 2 improves on the embodiment diagrammed in FIG. 1 by having the all exposed surfaces coated or encased in a protective substance [139] that also serves to cover any sharp edges of the worker support stand, provide coloration and protect the worker from electrical shock. FIG. 2 illustrates a dielectric insulation [109] and a dielectric coupling [110] made with dielectric materials [111] that individually and in combination protect the worker from electrical shock. An electrostatic discharger [112] is shown affixed to the base [102] to provide a path to ground for accumulated electrostatic charge. FIG. 2 shows an attachment point [143] to which a safety belt (not shown) may be attached to mitigate hazard of falling off the worker's support stand. FIG. 2 also shows a place for a first aid kit [152]. FIG. 2 also shows a means [142] for attaching a protective shield (not shown) that extends over the worker to protect against falling objects or environmental hazards like sunlight and wind.

Worrying about danger is mentally tiring, and control of structural instability is tiring. FIG. 2 illustrates how light reflector [120] can be placed on the surface to illuminate the worker support stand at night in dark areas or along roadsides. FIG. 2 shows stability enhancement by a leveler [113], and a filler aperture [125] to provide a ballast [124] to the base [102], and a stabilizing appendage [126].

FIG. 2 shows ergonomic features to reduce muscle and skeletal stress of the upper body. FIG. 1 illustrates how ergonomic workstand includes an upper torso support [107] with an upper torso support assist [131] to reduce stress in certain positions; an articulated multi-directional positioner [117] and ergonomic material [133] chosen to reduce pressure on the torso; an upper torso support extender [130] to adjust to the length of the worker's upper torso; and an adjustable upper torso appendage support [118] to reduce stress and fatigue in holding or supporting objects. An innovation of the upper torso support [107] provides an upper torso support reverser [134] to allow the worker to select which side of the upper torso support for use by the worker for certain work situations.

FIG. 2 illustrates features for reducing energy expenditure, stress and strain from climbing upon and down from the worker support stand with tools and materials. FIG. 1 illustrates a work item transport [151] such as a motorized or manual pulley to move tools and materials from the base to the worker's position.

FIG. 2 illustrates ergonomic means to facilitate work and lessen energy expense while the worker is upon the worker's support stand. The means include a stem levitation means [158]; an upper torso support item holding means [132] for the worker's tools and materials; work item attaching means [115] with auxiliary power provisioning means [119] such as pneumatic, electrical for power-augmented tools; a work item support means [144] to mechanically uphold items in the course of work; a tray attachment means [140] for a tray means [157] to contain and make convenient placing parts and tools; a control panel means [150] controlling illumination means [148] to operate the levitator, or light the work area or otherwise make work easier.

Referring now to FIG. 3 which diagrammatically illustrates the perspective top view of the ergonomic upper torso support [107] seen in FIG. 2. The drawing elements used throughout FIG. 2 are for example only. There is an ergonomic upper torso support frame [154] with open space for the mobility means [101]. The frame [154] is coated with a protective substance [139] and, on the top and bottom sides of the upper torso support, with ergonomic surfaces [133]. Which side of the upper torso support is up is controlled by an upper torso support reverser [134]. There are provided work item attaching means [115] conveniently placed along the upper torso support frame [154]. The frame includes open spaces to grasp, thereby providing handles [138] for moving the stand and couplings at the front and rear. The space [118] in each handle [138] also provides a place for the worker to lean his elbows, also called the upper torso appendage support. At the front of the upper torso support [107] is an upper torso support assembly latch [128]. The coupling at the rear of the upper torso support frame [154] receives an upper torso support extender [130], which in turn fits to an upper torso support item holder [132] to hold work items. In a preferred embodiment, the upper torso support frame [154] has a section that is extendible to ergonomically lengthen or foreshorten the upper torso support [107]. A medical supplies compartment [152] is provided to hold bandages and salves in case of a minor injury. A coupling at the rear of the upper torso support includes an upper torso support assembly latch [128] that securely connects to the straight upright extension of stems fitting [127] (FIG. 10) or to the arcuate extension-of-stems fitting [127] (FIG. 2). In the preferred embodiment the upper torso support has thereon an articulating upper torso support assist [131] for user selectable ergonomic comfort. Holes or protrusions along the frame of the upper torso support provide work item support [144], provide connection [142] for a protective shield; illumination devices [148]; powered tools; a computer holder [153]; and communicator device connector [129]. The upper torso support frame [154] has a tray attachment means [140] and points for attaching the stabilizing appendage [126]. In a preferred embodiment the upper torso support frame [154] also is equipped with a liquid refreshment holder [155]. In a preferred embodiment, there is an environmental conditioner [159] such as a heater pad or water mist spray for cooling in very hot weather. Referring now to FIG. 4 which diagrammatically illustrates the bottom view of the opposing side [135] of the upper torso support. The opposing side [135] has features for ergonomic comfort and with features to reduce work stress and strain. The drawing elements used throughout FIG. 4 are for example only. FIG. 4 shows an extender, such as telescoping means [122] to lengthen or foreshorten the upper torso support to ergonomically adjust to fit various torso shapes. The ergonomic upper torso support frame [154] is coated with a protective substance [139] and with upper torso support ergonomic surfaces [133] on the top and bottom sides. Which side is the upper surface is controlled by an upper torso support reverser [134]. The upper torso support frame [154] includes handles which are motility means [138] for moving the stand, and also includes couplings at the front and rear. The coupling at the front is an upper torso support assembly latch [128] and extension-of-stems fitting [127] (FIGS. 1, 2, 10). The purpose of the coupling at the rear of the upper torso support frame [154] is to fit with an upper torso support extender [130]. FIG. 4 shows the upper torso support item holder [132] and ergonomic material [133]. The upper torso support frame [154] has a section that is the extendible means to ergonomically lengthen or foreshorten the upper torso support [107]. The coupling at the rear is an upper torso support assembly latch [128] that securely connects to the upright stem [105] or extension-of-stems fitting [127]. In the preferred embodiment the frame has an articulating upper torso support assist [131] extending there from for user selectable ergonomic comfort. Holes or protrusions along the frame [154] provide work item support means [144], and provide connection [142] for a protective shield (not shown) [142]. There also is provided a control panel [150] for controlling ergonomic adjustable means such as illumination devices [148]; powered tools; and a computer holder [153]. In a preferred embodiment the upper torso support frame [154] has a tray attachment means [140] for mounting a tray or holding small items as well as a computer holder [153] and points for attaching the stabilizing appendage [126]. In a preferred embodiment the convenience tray [161] is equipped with a liquid refreshment holder [155]. a computer holder [153], and tray compartments [147] to hold small components used in performing work. There is also a place to attach a safety belt at the safety belt attachment point [143].

FIG. 5 diagrammatically illustrates a front view of the worker's support stand. The drawing elements used throughout FIG. 5 are for example only. FIG. 5 illustrates diagrammatically the mobility means [101], in this example wheels; base [102]; adjustable stem bracket [103]; adjustable ergonomic seating [104]; upright stem [105]; lower extremity support [106] (fixed, movable, reconfigurable); base-to-stem joint [108]; dielectric insulation [109]; dielectric coupling [110], and leveling means [113].

Continuing reference is made to FIG. 5. The drawing elements used throughout FIG. 5 are for example only. The items illustrated in FIG. 5 are the mobility means [101]; base [102]; adjustable stem bracket [103]; adjustable ergonomic seating [104]; upright stem [105]; lower extremity support (fixed, movable, reconfigurable) [106]; upper torso support [107]; base-to-stem joint [108]; dielectric insulation [109]; dielectric coupling [110] and leveling means [113]. FIG. 5 shows diagrammatically the frame is coated with a protective substance [139] and an adjustable seat mount [149] for working at lower elevations or resting before mounting the worker support stand.

FIG. 6 diagrammatically illustrates an optional version of the base of the worker's support stand. The drawing elements used throughout FIG. 6 are for example only. FIG. 6 illustrates the base [102], mobility means [101], in this case diagramed as wheels; a storage compartment [114] for tools and accessories; as well as a refillable ballast container [124] that can be filled by adding a water or other material through the filler aperture [125] and emptied to add weight for enhancing the stability of the worker support stand. FIG. 6 shows fittings for electrical and other auxiliary power means [119] for supplying power to the worker support stand as well as energy attachment means [137], such as a hose from a pressurized tank or fuel cell or electrical supply cords for charging a rechargeable electrical power source.

I refer now to FIG. 7, which diagrammatically illustrates a view of the of the worker's support stand with addition of an advantageous extension piece. The drawing elements used throughout FIG. 7 are for example only. FIG. 7 illustrates the mobility means [101]; base [102]; adjustable stem bracket [103]; adjustable ergonomic seating [104]; upright stem [105]; lower extremity support [106] (which can be fixed or removable); upper torso support [107]; base-to-stem joint [108]; dielectric insulation [109]; dielectric coupling [110]; leveling means [113]; storage compartment [114]; work item attaching means [115]; ergonomically adjustable foot-knee support [116]; light reflector [120]; work-device attachment means [121]; extender [122]; mobility device attachment means [123]; stabilizing appendage [126]; extension-of-stems fitting [127]; levitator [145]; stem extender piece [146]; refillable ballast container [124]; illumination devices [148]; adjustable seat mount [149]; work item transporter [151]; medical supplies compartment [152]; and upper torso support frame [154]. FIG. 6 shows the tray [157] and environmental conditioner [159] such as a heater pad or water mist spray for cooling in very hot weather.

FIG. 8 shows the position of the upper torso support [107] reversed 90 degrees for ergonomic positioning to support the torso at a higher angle, such as when reaching upward. All the numbered references are the same as that for FIG. 7.

Referring now to FIG. 9 which illustrates a collapsed worker's support stand after closing storage compartments [114], removing power sources from the power attachment means [137], optionally removing the tray means [157] from the tray attachment means [140], and stowing any protruding appurtenances. FIG. 9 illustrates how after stowing the stabilizing appendage means [126] and leveling means [113], the upright stem [105] and folded upper torso support [107] folds by releasing the adjustable stem bracket [103] by releasing the upper torso support assembly latch [128]; thus letting the upper torso support [107] fold against the upright stem [105], using the stem levitation means [158] to lower the upright stem [105] is aligned with the horizontal surface of the base [102]. Affixing the stowage latch means [156] keeps the worker support stand closed. The collapsed worker stand moves on the surface by attaching a vehicle or pulling-bar to the mobility means [101] or by pushing or pulling on the handle(s) [138]. FIG. 8 shows degree of inclination indicator means [136] which provide a reference for safe levelness. This figure omits showing the tray means and other potential features for clarity reasons.

OPERATION OF INVENTION

Use of the apparatus begins with setup for ergonomic comfort, efficiency and safety. Whether erect or collapsed, the worker support stand can be moved by pushing or pulling on the handle [138] or by attaching a vehicle or other mobile unit to the mobility device attachment means [123]. Setup from the collapsed configuration is required to mount the worker's support stand. Once setup, the worker's stand can generally be reused without need for collapse until ready to transport or place it in storage. The user moves the worker's support stand to the work location by using the mobility device attachment means [123] or the handle (motility means) [138] to move the apparatus, taking advantage of the ergonomic advantage of the mobility means [101]. With the worker's stand located at the workplace, the stowage latch [156] is released, and the upright stem [105] and the upper torso support [107] are ergonomically moved upward from the collapsed position by the stem levitator [158]. The upright stem [105] can be adjusted to a preferred angle appropriate for the work at hand by changing its slope. This adjustment is accomplished by selecting an appropriate position for, and locking the adjustable stem bracket [103] of the base-to-stem joint [108], and further with the stem assembly latch [141]. If desired, the adjustable ergonomic seating [104] is added to the upright stem [105], adjusting the position with the adjustable seat mount [149]. If the work to be performed is above eye level (about 1.8 meters), one or more stem extender piece [146] may be added using either type (upright or arcuate) of the extension-of-stems fitting [127].

Next, the worker can decide to refine the configuration of the upper torso support [107] by inserting a tray means [157]. In a preferred embodiment the tray means [157] has a personal computer installed securely into position in the computer holder means [153] of the upper torso support frame [154].

With the stem [105] at about the right working height, the user decides which surface of the upper torso support [107] should be uppermost, and with that surface as the top surface, connects the upper torso support [107] in place by inserting the top end into the upper torso support assembly latch [128].

The position of the upper torso support [107] may be adjusted using the multi-directional positioner [117]. The upper torso support extension means [130] may be extended to its most ergonomic position and adjusted for personal comfort with the upper torso support assist [131] and work item support [144].

If power tools are to be used, then attach the power provisioning means [119] being electrical, hydraulic, or pneumatic at the appropriate location on the worker support stand.

For ergonomic convenience add a tray means [157] to the upper torso support means [107] using the tray attachment means [140]. Select any items that will be used in the work from in the storage compartment [114]. Place these items in compartments [140] of the tray means [157] or attach work tools or materials using the work item attaching means [115] and work-device attachment means [121].

Safety is very important. To improve safety, the stabilizing appendage [126] is extended; ropes or poles may be positioned as outriggers for additional stability, and the filler aperture [125] is used to fill the refillable ballast container [124] with water, sand or other material. Also the items in the first aid kit [152] are checked. If the worker support stand is on a sloping surface, the mobility device [101] is set to its locked state, and the leveling means [113] used to correct for the slope of the surface.

The user then decides whether to attach the ergonomically convenient work item transport [151] and a protective shield (not shown) into the protective shield holder [142].

Next, when the user is ready to begin work, he mounts the worker support stand, being sure to attach the safety belt at the safety belt attachment point [143]. The levitator [145] is used to adjust the height of the work stand. After beginning work, the user may change position as required by adjusting the rotational angle and elevation of the upper torso support [107] from time to time for optimum ergonomic benefit. For ergonomic convenience, he may use the work item transport [151] to raise or lower work items in order to avoid climbing up and down the lower extremity supports [106], which is tiresome and can cause stress.

The worker exploits the ergonomic features of the apparatus such as the adjustable seat mount [149], the stem levitator [158], the environment conditioning means [159], the labor-saving work item support [144] and the upper torso support item holder [132], as well as the extender [122] to position work items for maximum advantage. Ergonomic comfort can be improved by deciding which side of the upper torso support [107] to use by using the upper torso support reversing means [134], selectively placing the ergonomically adjustable foot-knee support [116], changing the position of the upper torso support extension means [130] in relation to the fitted upper torso support frame [154], positioning the upper torso support assist [131], the multi-directional positioner [117]; upper torso appendage support [118] illumination devices [148]; computer holder means [153]; and the refreshment holder [155].

Before getting on the worker support stand, the worker should consider safety of utmost importance by extending the stabilizing appendage means [126], cleaning the light reflecting means [120];

CONCLUSION, RAMIFICATIONS AND SCOPE OF THE INVENTION

The scope of the invention includes convenience, safety, and ergonomic energy saving and stress reducing features which allow the worker to be more comfortable, less tired when working for extended time and thus more productive. The ramifications of my invention are that workers' will benefit from ergonomic features of the worker's support stand when it is used in performing their assigned tasks. Repeated use of the ergonomic worker's stand will result in less physical and mental fatigue by considering the worker's comfort in performing difficult tasks.

I claim:

1. An ergonomic worker support stand comprising:

a base having an I-shape in plan view, comprising a pair of horizontally disposed legs spaced apart and joined by a central connecting section;

a central upright stem having distal and proximal ends, the proximal end connected to the central connecting section of the base;

a plurality of worker lower extremity supports extending laterally outward from both sides of the central upright stem at positions along the upright stem, wherein the lateral extent of the lower extremity supports decreases from lowest to highest positions on said upright stem;

an extension of stems fitting having a distal end and a proximal end, the proximal end adjustably coupled to the distal end of the upright stem; and an upper torso support adjustably coupled to the distal end of the extension of stems fitting;

wherein the upper torso support comprises opposing top and bottom sides, and wherein the upper torso support is reversible to place either the top or the bottom side facing upward, wherein the upper torso support is pivotally attached to the extension of stem fitting to be selectively pivotable in a horizontal plane about a vertical axis in relation to the extension of stems fitting, the extension of stems fitting comprises two portions defining an angle between the distal end and the proximal end and is reversibly positionable in relation to the upright stem, thereby to adjust an angular relationship between the upright stem and the upper torso support.

2. A worker support stand as described in claim 1 further comprising a dielectric coupling connecting the upright stem and the extension of stems fitting.

3. A worker support stand as described in claim 1 further comprising an electrostatic discharger connected to the base.

4. A worker support stand as described in claim 1 further comprising at least one foot-knee support adjustably attached to at least one of the lower extremity supports.

5. A worker support stand as described in claim 1 further comprising at least one upper torso appendage support attached to the upper torso support and adjustably positionable to accommodate the worker's upper torso appendages.

6. A worker support stand as described in claim 1 further comprising an inclination indicator on the base.

7. A worker support stand as described in claim 1 further comprising at least one mobility device attachment means on the base.

8. A worker support stand as described in claim 1 wherein the base is hollow and comprises a filler aperture whereby ballast material may be added into the base.

9. A worker support stand as described in claim 1 wherein the extension-of-stems fitting defines an arcuate shape moveable in relation to the upright stem for adjusting the height of the upper torso support.

10. A worker support stand as described in claim 1 wherein said lower extremity supports are selectively removable from the upright stem.

11. A worker support stand as described in claim 1 further comprising a handle extending from the upper torso support to aid in the worker in positioning his/her body for work.

12. A worker support stand according to claim 1, wherein the extension of stems fitting comprises an extension of stems fitting, arcuate along at least a portion of its length.

13. A worker support stand according to claim 1 further comprising a stem extender piece coupled between the upright stem and the extension of stem fitting.

* * * * *